US009328975B2

(12) United States Patent
Furumaki et al.

(10) Patent No.: US 9,328,975 B2
(45) Date of Patent: May 3, 2016

(54) DRAINAGE STRUCTURE OF CORRUGATED FIN-TYPE HEAT EXCHANGER

(75) Inventors: Masayuki Furumaki, Shizuoka (JP); Takeshi Yoshida, Shizuoka (JP); Kazuhiko Yamazaki, Shizuoka (JP)

(73) Assignees: NIPPON LIGHT METAL COMPANY, LTD., Tokyo (JP); SHARP KABUSHIKI KAISHA, Osaka-shi (JP)

( * ) Notice: Subject to any disclaimer, the term of this patent is extended or adjusted under 35 U.S.C. 154(b) by 183 days.

(21) Appl. No.: 13/257,230

(22) PCT Filed: Mar. 8, 2010

(86) PCT No.: PCT/JP2010/001624

§ 371 (c)(1),
(2), (4) Date: Sep. 16, 2011

(87) PCT Pub. No.: WO2010/106757

PCT Pub. Date: Sep. 23, 2010

(65) Prior Publication Data

US 2012/0272677 A1 Nov. 1, 2012

(30) Foreign Application Priority Data

Mar. 17, 2009 (JP) ..... 2009-064876
Mar. 23, 2009 (JP) ..... 2009-069372

(51) Int. Cl.
*F25D 21/14* (2006.01)
*F28F 17/00* (2006.01)
(Continued)

(52) U.S. Cl.
CPC ..... *F28F 17/005* (2013.01); *F28D 1/05383* (2013.01); *F28F 1/128* (2013.01)

(58) Field of Classification Search
CPC .. F28D 1/05383; F28D 1/0478; F28F 17/005; F28F 1/126; F28F 1/128; F28F 17/00; F28F 2215/12; F28F 1/34; F25D 21/14
USPC ..... 62/290, 285, 288, 272; 165/151, 913, 165/181
See application file for complete search history.

(56) References Cited

U.S. PATENT DOCUMENTS 3,832,965 A * 9/1974 Walker ..... B63B 25/10 114/321
5,865,243 A 2/1999 Kato et al.
(Continued)

FOREIGN PATENT DOCUMENTS

JP 62-204251 U 12/1987
JP 4-324093 A 11/1992
(Continued)

OTHER PUBLICATIONS

International Search Report, dated Apr. 13, 2010, issued in PCT/JP2010/001624.
(Continued)

*Primary Examiner* — Frantz Jules
*Assistant Examiner* — Martha Tadesse
(74) *Attorney, Agent, or Firm* — Birch, Stewart, Kolasch & Birch, LLP

(57) ABSTRACT

A drain structure for a corrugated fin-type heat exchanger, the corrugated fin-type heat exchanger being constituted by arranging a plurality of flat heat exchange tubes parallel to one another in a horizontal direction between a pair of opposing header pipes, and joining corrugated fins between the plurality of flat heat exchange tubes, the drain structure including a plurality of water flow passages for inducing water retained between the corrugated fins adjacent to an upper side and a lower side of each of the plurality of flat heat exchange tubes, the plurality of water flow passages being formed on an outer end surface of the each of the plurality of flat heat exchange tubes in a width direction thereof at a pitch along a longitudinal direction of the each of the plurality of flat heat exchange tubes.

10 Claims, 15 Drawing Sheets

(51) Int. Cl.

| | |
|---|---|
| ***F28F 1/34*** | (2006.01) |
| ***F28D 1/053*** | (2006.01) |
| ***F28F 1/12*** | (2006.01) |

(56) References Cited

U.S. PATENT DOCUMENTS

| | | | | |
|---|---|---|---|---|
| 6,561,262 | B1 * | 5/2003 | Osakabe | F28D 15/0266 165/104.21 |
| 2004/0035559 | A1 | 2/2004 | Ko et al. | |
| 2008/0196876 | A1 * | 8/2008 | Cao | F28F 1/36 165/181 |
| 2008/0202153 | A1 * | 8/2008 | Watanabe | F25B 39/022 62/498 |
| 2008/0236191 | A1 | 10/2008 | Tsuchiya | |
| 2009/0211733 | A1 * | 8/2009 | Tranier | F25J 3/04412 165/104.21 |
| 2010/0107675 | A1 * | 5/2010 | Lifson | F24F 1/0059 62/285 |

FOREIGN PATENT DOCUMENTS

| | | | | |
|---|---|---|---|---|
| JP | 09101092 | A | * | 4/1997 |
| JP | 2000-241093 | A | | 9/2000 |
| JP | 2001-263861 | A | | 9/2001 |
| JP | 2004-85170 | A | | 3/2004 |
| JP | 2007-183029 | A | | 7/2007 |
| JP | 2007-285673 | A | | 11/2007 |
| JP | 2007285673 | A | * | 11/2007 |
| JP | 2008-270789 | A | | 11/2008 |
| JP | 2010-25477 | A | | 2/2010 |

OTHER PUBLICATIONS

English translation of International Preliminary Report on Patentability issued Oct. 18, 2011, in PCT International Patent Application No. PCT/JP2010/001624.

* cited by examiner

DRAINAGE STRUCTURE OF CORRUGATED FIN-TYPE HEAT EXCHANGER

TECHNICAL FIELD

The present invention relates to a drain structure for a corrugated fin-type heat exchanger, and more specifically, to a drain structure which achieves improvement in drainage of a parallel flow heat exchanger having corrugated fins and flat heat exchange tubes alternately arranged therein.

BACKGROUND ART

In general, a corrugated fin-type heat exchanger is widely used, which is constituted by arranging a plurality of flat heat exchange tubes parallel to one another in a horizontal direction between a pair of opposing header pipes, and joining corrugated fins between the heat exchange tubes. In a case where the corrugated fin-type heat exchanger of this kind is used as an evaporator, for example, condensed water (dew water) adheres to the surface thereof, which increases an airflow resistance, and further, inhibits heat transfer due to a resistance of a water film adhering to the surfaces of the corrugated fins. As a result, there arises a problem of decrease in heat exchange performance.

As means for solving the above-mentioned problem, there is known a drain structure having a plurality of guide plates arranged in contact with the corrugated fins on a downstream side of a supply air flow, the guide plates causing water droplets adhering to the corrugated fins to fall downward (see, for example, Patent Literature 1).

As another means for solving the above-mentioned problem, there is known a drain structure in which drain guides to be brought into contact with the corrugated fins are each formed of a linear member on a concentrating side of the condensed water, and the drain guides are arranged obliquely to the heat exchange tubes and at least one of the ends of the drain guides is led to a lower end or side end of the corrugated fin-type heat exchanger (see, for example, Patent Literature 2).

In the technology described in Patent Literature 1, it is necessary to increase, for a high drainage, adherence and the number of contacts between the corrugated fins and the guide plates. Further, in the technology described in Patent Literature 2, it is necessary to arrange, for a high drainage, many drain guides such as wires at a relatively small pitch.

CITATION LIST

Patent Literature

PTL 1: JP 2001-263861 A
PTL 2: JP 2007-285673 A

SUMMARY OF INVENTION

Technical Problem

However, in the technologies described in Patent Literature 1 and Patent Literature 2, it is necessary to increase, for a high drainage, the adherence and the number of contacts between the corrugated fins and the guide plates, or alternatively, arrange many drain guides such as wires at a relatively small pitch. As a result, the flow of air passing through the heat exchanger may be inhibited, which may lead to a fear of increase in airflow resistance.

The present invention has been made in view of the above-mentioned circumstances, and it is therefore an object thereof to provide a drain structure for a corrugated fin-type heat exchanger, which has, for example, in a case where the corrugated fin-type heat exchanger is used as an evaporator, a sufficient drainage of condensed water (dew water) adhering to a surface thereof to suppress an adverse effect on an airflow resistance and a heat exchange efficiency, even in a case where heat exchange tubes are arranged horizontally.

Solution to Problem

In order to solve the above-mentioned problem, a drain structure for a corrugated fin-type heat exchanger according to a first aspect of the present invention, the corrugated fin-type heat exchanger being constituted by arranging a plurality of flat heat exchange tubes parallel to one another in a horizontal direction between a pair of opposing header pipes, and joining corrugated fins between the plurality of flat heat exchange tubes, includes a plurality of water flow passages for inducing water retained between the corrugated fins adjacent to an upper side and a lower side of each of the plurality of flat heat exchange tubes, the plurality of water flow passages being formed on an outer end surface of the each of the plurality of flat heat exchange tubes in a width direction thereof at a pitch along a longitudinal direction of the each of the plurality of flat heat exchange tubes.

In the first aspect of the present invention, the plurality of water flow passages may each be formed by lug pieces, which are obliquely or vertically cut and lugged in a flange portion provided so as to integrally extend along an end portion of the each of the plurality of flat heat exchange tubes in the width direction, or the plurality of water flow passages may each be formed by a groove portion, which is formed in an end portion of the each of the plurality of flat heat exchange tubes in the width direction through cutting performed obliquely or vertically over a range of from the upper side to the lower side.

Further, in the first aspect of the present invention, it is preferred that at least part of each of the plurality of water flow passages be positioned on an inner side of a side end portion of each of the corrugated fins.

In addition, in the first aspect of the present invention, it is preferred that the pitch of the plurality of water flow passages is in a range of four times or smaller than a pitch of each of the corrugated fins.

According to the above-mentioned configuration of the first aspect of the present invention, under a state in which the condensed water (dew water) in the form of water droplets, which is condensed on the surface of the corrugated fin, is retained between the corrugated fins adjacent to the upper and lower sides of the heat exchange tube, the edge portions of the water flow passage are brought into contact with the retained water, and therefore serve as a water-falling origin. As a result, the water can be induced and drained to the lower corrugated fin.

Further, a drain structure for a corrugated fin-type heat exchanger according to a second aspect of the present invention, the corrugated fin-type heat exchanger being constituted by arranging a plurality of flat heat exchange tubes parallel to one another in a horizontal direction between a pair of opposing header pipes, and joining corrugated fins between the plurality of flat heat exchange tubes, includes a water passage for inducing water droplets adhering to the corrugated fin-type heat exchanger, the water passage being formed by a linear drain assisting member, which is arranged so as to extend along each of the plurality of flat heat exchange tubes and to come into contact with the corrugated fins adjacent to an upper side and a lower side of the each of the plurality of flat heat exchange tubes.

With this configuration, the water droplets adhering to the heat exchanger run through the upper corrugated fin to flow into the drain assisting member arranged along the lower heat exchange tube, and are drained to the lower corrugated fin via the water passage formed by the drain assisting member.

In the second aspect of the present invention, the linear drain assisting member may be a wire which is arranged to define a fine clearance so as to form the water passage between the wire and the each of the plurality of flat heat exchange tubes.

With this configuration, the water droplets adhering to the corrugated fin are induced to the clearance between the drain assisting member and the heat exchange tube, and are drained to the lower corrugated fin with the clearance serving as the water passage.

Further, in the second aspect of the present invention, the linear drain assisting member may have a shape in which a plurality of linear materials are twisted together, the water passage may be formed in a clearance defined among the linear materials, and the clearance may be positioned on an inner side of a side end of each of the corrugated fins.

With this configuration, the water droplets adhering to the corrugated fin run into the drain assisting member arranged in the vicinity thereof from an open peak portion of a corrugated shape (peak-to-valley shape), and are drained to the lower corrugated fin with the gap of the drain assisting member itself (clearance defined among the linear materials) serving as the water passage.

Further, in the second aspect of the present invention, it is preferred that the linear drain assisting member be formed of the same material forming the corrugated fin-type heat exchanger, and be integrally joined to the corrugated fin-type heat exchanger by brazing.

Further, in the second aspect of the present invention, the linear drain assisting member may be wool or a chenille-laced linear material, water droplets adhering to a surface of the wool or the chenille-laced linear material may be induced to a water film or water droplets on a surface of the linear drain assisting member, and the water passage be formed in the surface.

With this configuration, when the heat exchanger becomes wet, the water droplets adhere to the surface of the wool or chenille-laced linear material forming the drain assisting member, and further the water film is formed on the surface. Further, the water droplets adhering to the corrugated fin are induced to the water film or water droplets on the surface of the wool or chenille-laced linear material forming the drain assisting member, and are drained to the lower corrugated fin with the surface serving as the water passage.

Further, in the second aspect of the present invention, it is preferred that the corrugated fin-type heat exchanger be vertically arranged or obliquely arranged with an upper end side of the corrugated fin-type heat exchanger positioned on a leeward side, and the linear drain assisting member be arranged on the leeward side.

With this configuration, as described above, the water droplets adhering to the heat exchanger can more efficiently be drained, on the leeward side of the heat exchanger, from the upper corrugated fin to the lower corrugated fin while running through the water passage formed by the lower drain assisting member.

Further, in the second aspect of the present invention, the corrugated fin-type heat exchanger may be vertically arranged or obliquely arranged with an upper end side of the corrugated fin-type heat exchanger positioned on a leeward side, and the linear drain assisting member may be arranged on a windward side and the leeward side.

With this configuration, as described above, the water droplets adhering to the heat exchanger can even more efficiently be drained, on the windward side and the leeward side of the heat exchanger, from the upper corrugated fin to the lower corrugated fin while running through the water passage formed by the lower drain assisting member.

Further, in the second aspect of the present invention, the corrugated fin-type heat exchanger may be vertically arranged or obliquely arranged with an upper end side of the corrugated fin-type heat exchanger positioned on a windward side, and the linear drain assisting member may be arranged on the windward side.

With this configuration, as described above, the water droplets adhering to the heat exchanger can be drained, on the windward side of the heat exchanger, from the upper corrugated fin to the lower corrugated fin while running through the water passage formed by the lower drain assisting member.

Advantageous Effects of Invention

According to the present invention, in a corrugated fin-type heat exchanger, it is possible to achieve a sufficient drainage of condensed water (dew water) adhering to a surface thereof to suppress an adverse effect on an airflow resistance and a heat exchange efficiency, even in a case where the heat exchange tubes are arranged horizontally.

DESCRIPTION OF EMBODIMENTS

Hereinbelow, referring to the accompanying drawings, detailed description is given of embodiments of the present invention.

Figure 1:
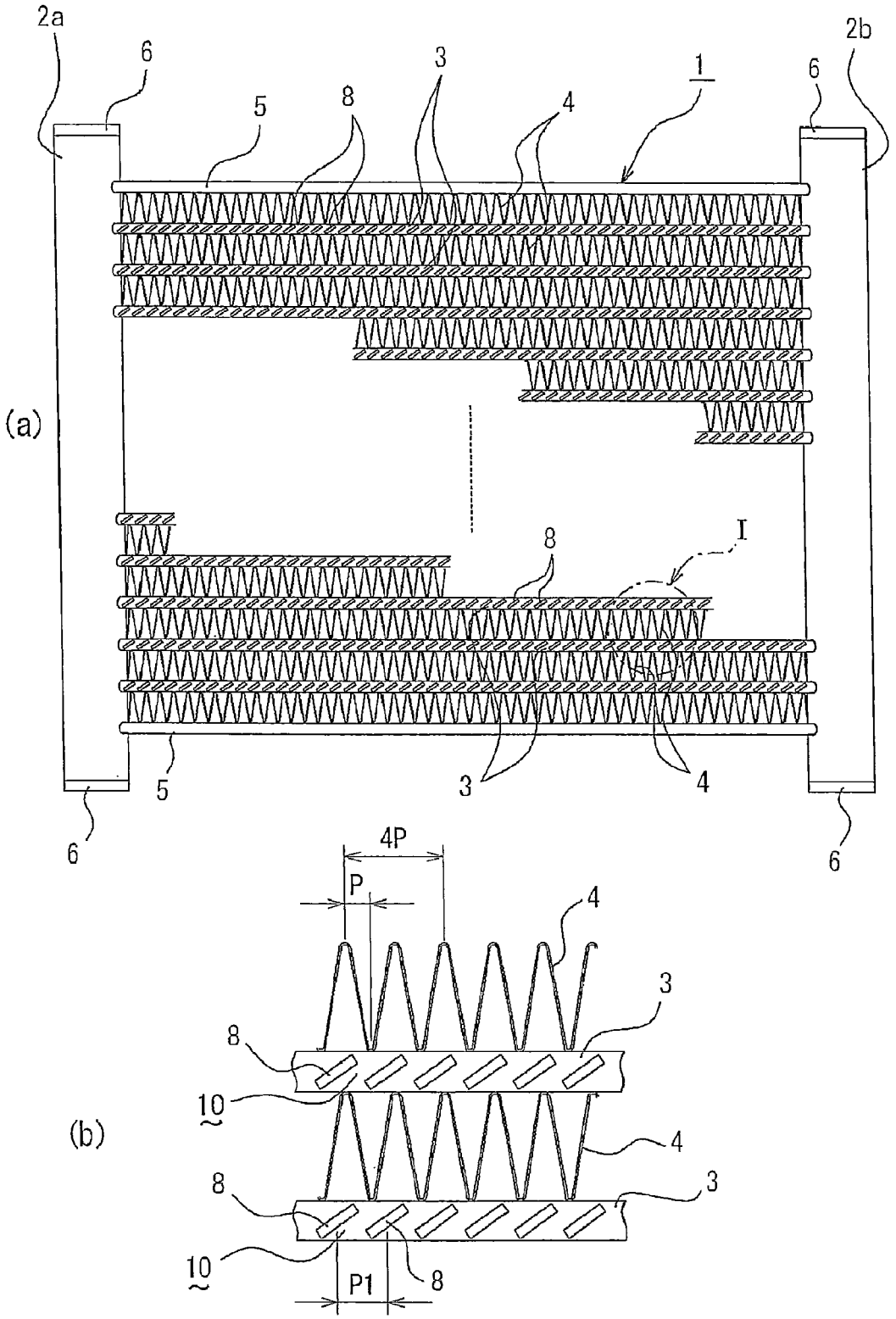
FIG. 1(*a*) is a front view illustrating a drain structure for a corrugated fin-type heat exchanger according to a first embodiment of the present invention, and FIG. 1(*b*) is an enlarged front view in the portion I of FIG. 1(*a*).

As illustrated in FIG. 1, a corrugated fin-type heat exchanger 1 according to the present invention includes a pair of laterally opposing header pipes 2*a* and 2*b* each made of aluminum (including aluminum alloy), a plurality of flat heat exchange tubes 3 bridged (continuously provided) in parallel to one another in a horizontal direction between the header pipes 2*a* and 2*b*, and corrugated fins 4 each interposed between adjacent heat exchange tubes 3, the heat exchange tubes 3 and the corrugated fins 4 being brazed to the header pipes 2*a* and 2*b*. Note that, the heat exchange tube 3 has a plurality of sectioned heating medium passages 3*a* formed therein. Further, on the upper outside and the lower opening side of the corrugated fins 4 at the upper and lower ends, side plates 5 made of aluminum are brazed, respectively. Further, at the upper and lower opening ends of the header pipes 2*a* and 2*b*, end caps 6 made of aluminum are brazed, respectively.

Figure 2:
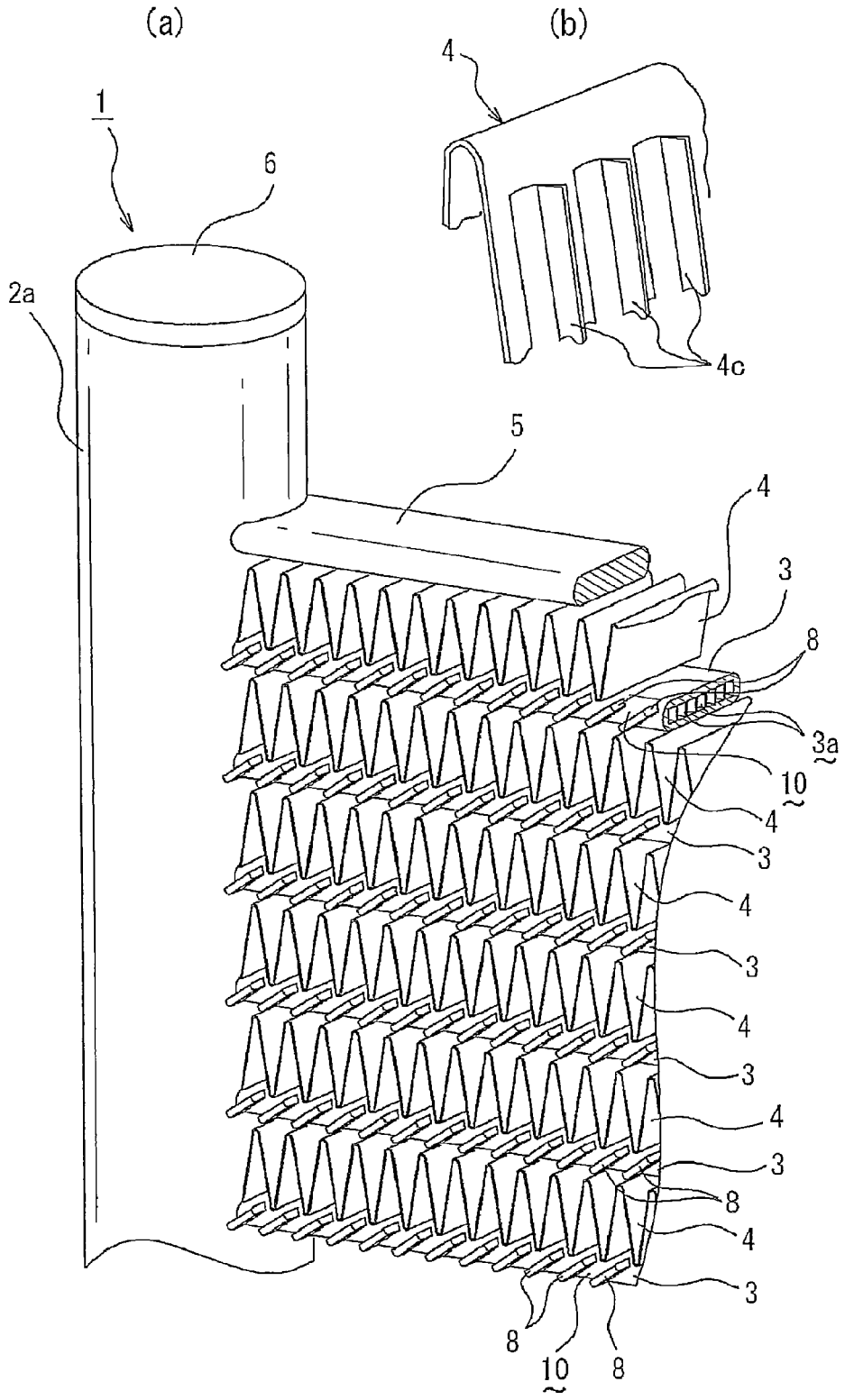
FIG. 2(*a*) is a perspective view illustrating a partial cross section of the drain structure according to the first embodiment of the present invention, and FIG. 2(*b*) is a partially enlarged perspective view of a corrugated fin according to the present invention.
Figure 3:
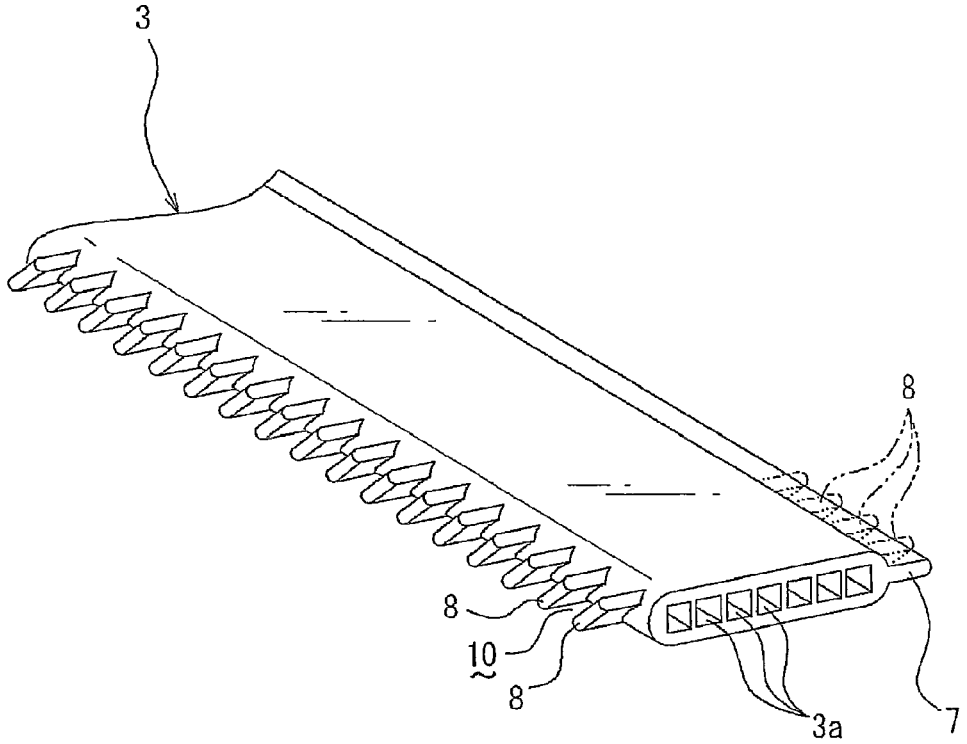
FIG. 3 is a perspective view illustrating a heat exchange tube having water flow passages according to the first embodiment.

In the heat exchanger 1 having the above-mentioned configuration, as illustrated in FIGS. 1 to 3, on a side end portion of the heat exchange tube 3 in its width direction, a flange portion 7 is provided so as to extend along a longitudinal direction of the heat exchange tube 3, and water flow passages 10 for inducing water retained between the corrugated fins 4 adjacent to the upper and lower sides of the heat exchange tube 3 are formed by lug pieces 8, which are, for example, obliquely cut and lugged in the flange portion 7 via cutouts at an appropriate pitch. In this case, as illustrated in FIG. 3, the flange portions 7 may be provided so as to extend along both the end portions of the heat exchange tube to form the lug pieces 8 in the flange portions 7 via cutouts.

Figure 4:
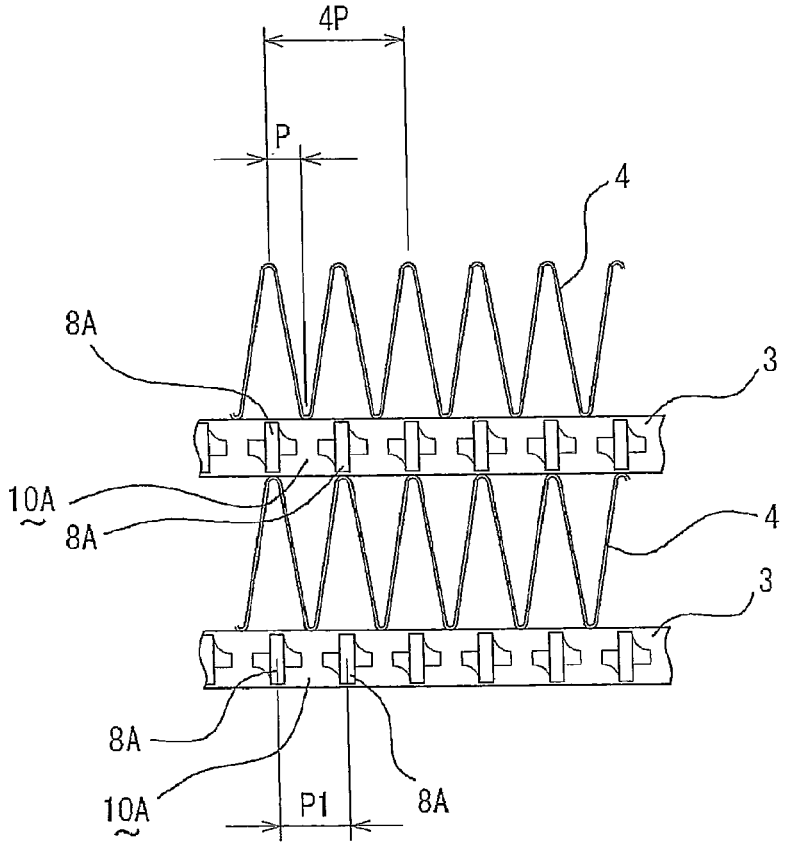
FIG. 4 is a main portion front view illustrating another form of the water flow passages according to the first embodiment.

Note that, as illustrated in FIG. 4, water flow passages 10A may be formed by lug pieces 8A, which are vertically cut and lugged with respect to the heat exchange tube 3.

In this case, when the water flow passage 10 (10A) is positioned on an outer side of the side end portion of the corrugated fin 4, condensed water (dew water) adhering to the corrugated fin 4 is retained between the adjacent upper and lower corrugated fins 4. Therefore, at least part of the water flow passage 10 (10A) needs to be positioned on an inner side of the side end portion of the corrugated fin 4.

In the heat exchanger 1 having the above-mentioned configuration, the corrugated fin 4 is formed by repeatedly accordion-folding a thin plate to have a predetermined height. In front view of the heat exchanger, the corrugated fin 4 may be viewed as successive V-shapes.

The drain mechanism according to the present invention has the following configuration. Because no water passage to the lower stage is provided with respect to the condensed water (dew water), which is condensed on the surface of a V-shaped (valley-folded) fin, the condensed water moves to an adjacent inverse-V-shaped (mountain-folded) portion via fin louvers 4*c* (see FIG. 2(*b*)), which are formed by cutting and lugging a plurality of longitudinal slits provided in parallel to one another in the width direction of the corrugated fin 4. The condensed water accumulated in the inverse-V-shaped portion flows into a lower corrugated fin 4 through a lower opening portion via the water flow passages 10 (10A) formed in the heat exchange tube 3. By smoothly repeating such a mechanism, the condensed water is prompted to be drained.

Note that, by providing the fin louvers 4*c* to the corrugated fin 4, heat exchange performance can be improved, that is, by providing a predetermined number of louvers formed in the air passage at a predetermined angle, heat transfer performance can be improved due to a turbulence effect or the like.

In this drain mechanism, when the pitch of the water flow passages 10 (10A) formed in the heat exchange tube 3 is four times or larger than the pitch of the corrugated fin 4 (peak-to-valley dimension), the number of drain passages connecting the upper and lower sides is reduced as compared to the water retention capability of the corrugated fins 4. Hence, the drain rate is extremely lowered, with the result that no practically effective drain effect can be obtained. Therefore, as illustrated in FIGS. 1(*b*) and 4, it is preferred that a pitch P1 of the water flow passages 10 (10A), that is, the lug pieces 8 (8A), be four times or smaller than a pitch P of the corrugated fin 4 (peak-to-valley dimension).

According to the drain structure having the above-mentioned configuration, when the surface of the heat exchanger becomes wet, under a state in which the condensed water (dew water) in the form of water droplets, which is condensed on the surface of the corrugated fin 4, is retained between the corrugated fins 4 adjacent to the upper and lower sides of the heat exchange tube 3, the edge portions of the lug pieces 8 (8A) {water flow passages 10 (10A)} are brought into contact with the retained water, and therefore serve as a water-falling origin. As a result, the water can be induced and drained to the lower corrugated fin 4. Subsequently, in the same manner, the condensed water (dew water) in the form of water droplets, which is condensed on the surface of the corrugated fin 4, is sequentially drained to the lower corrugated fin 4.

The above-mentioned embodiment has described the case where the water flow passages 10 (10A) are formed by the lug pieces 8 (8A), which are obliquely or vertically cut and lugged via cutouts in the flange portion 7 provided so as to extend along the end portion of the heat exchange tube 3 in the width direction. However, the present invention is not necessarily limited to the configuration of this embodiment.

Figure 5:
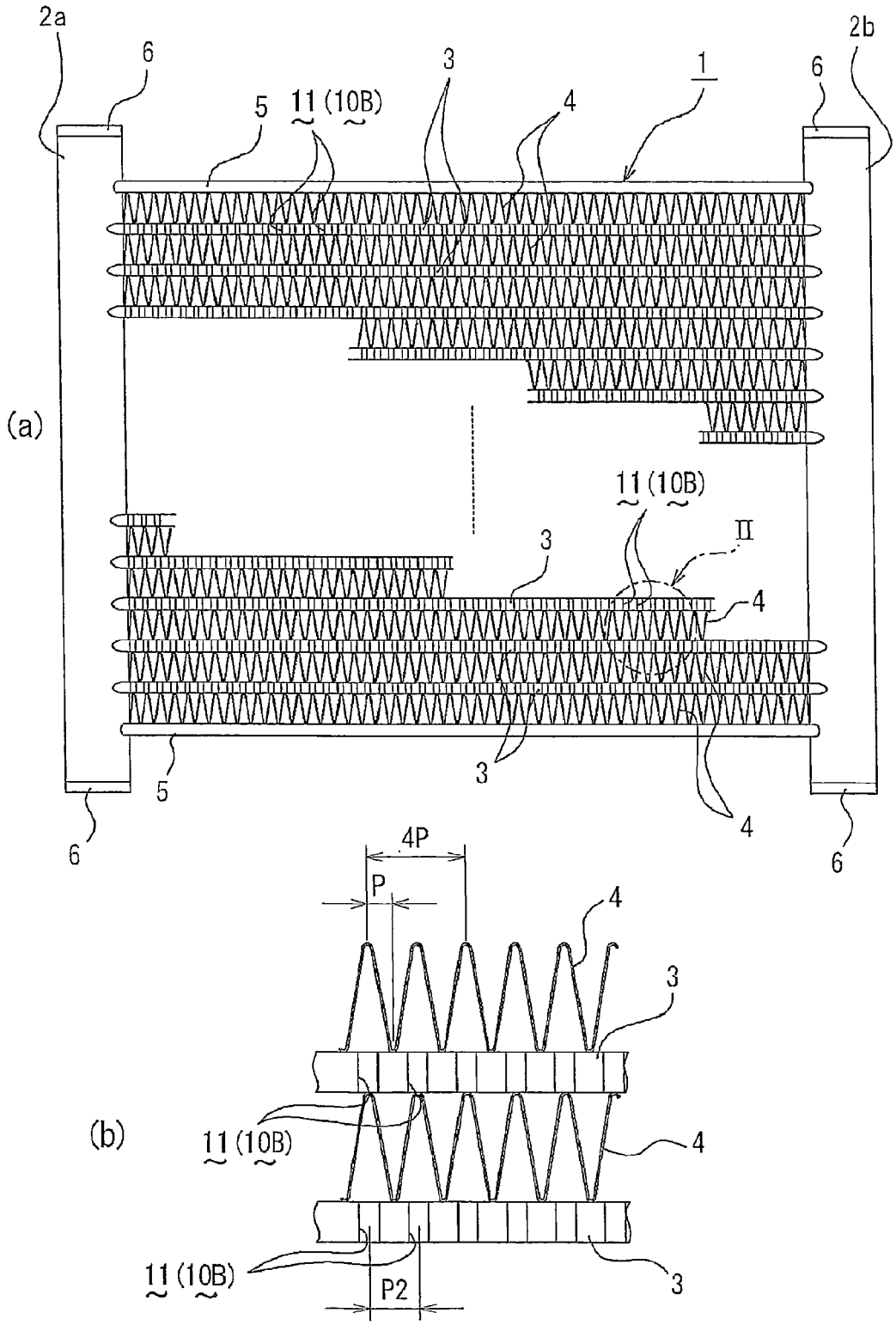
FIG. 5(*a*) is a front view illustrating a drain structure for a corrugated fin-type heat exchanger according to a second embodiment of the present invention, and FIG. 5(*b*) is an enlarged front view in the portion II of FIG. 5(*a*).
Figure 6:
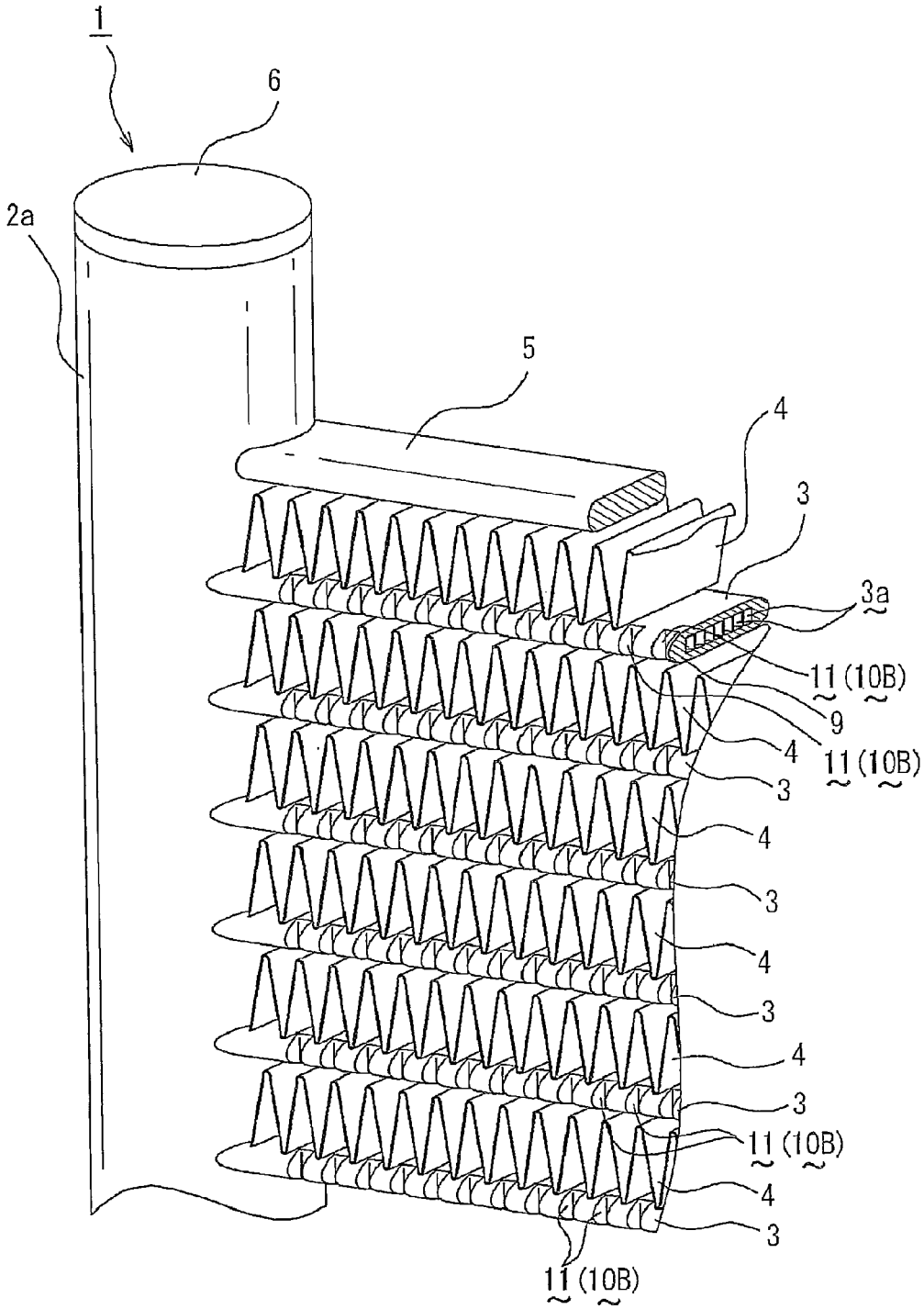
FIG. 6 is a perspective view illustrating a partial cross section of the drain structure according to the second embodiment of the present invention.
Figure 7:
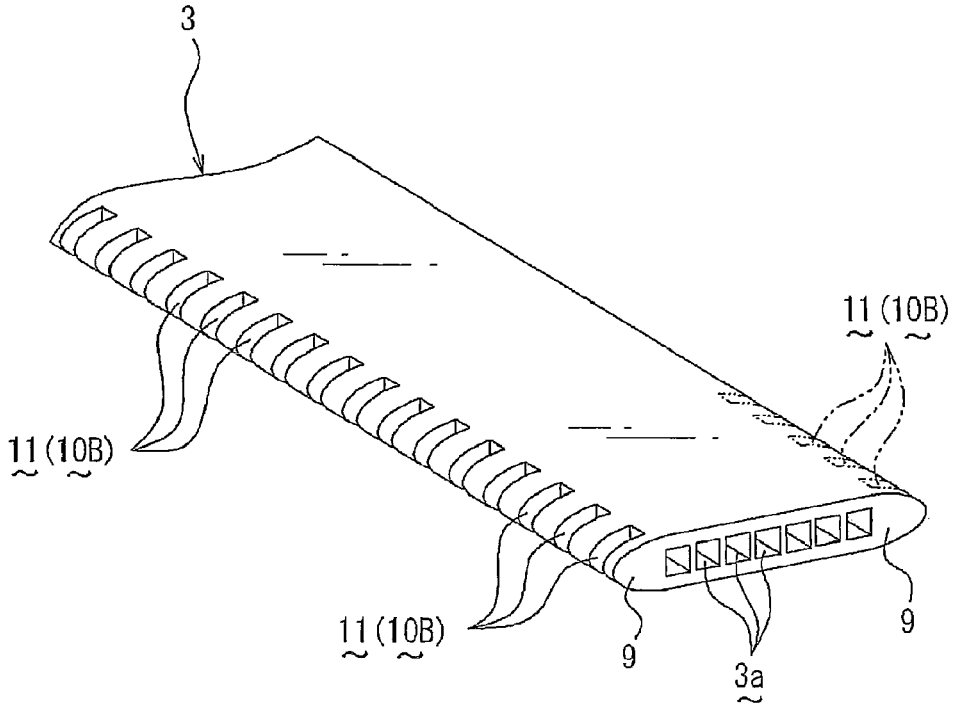
FIG. 7 is a perspective view illustrating a heat exchange tube having water flow passages according to the second embodiment.

For example, as illustrated in FIGS. 5 to 7, a thick portion 9 may be provided to the end portion of the heat exchange tube 3 in the width direction, and a groove portion 11 may be formed by, for example, vertically cutting out the thick portion 9 over the range of from the upper side to the lower side, to thereby form water flow passages 10B. In this case, a plurality of groove portions 11 are provided at an appropriate pitch P2 along the longitudinal direction of the heat exchange tube 3, and at least part of the groove portion 11 is positioned on the inner side of the side end portion of the corrugated fin 4. Further, the pitch P2 of the groove portions 11, that is, the water flow passages 10B, falls in the range of four times or smaller than the pitch P of the corrugated fin 4 (peak-to-valley dimension). In this case, as illustrated in FIG. 7, the thick portions 9 may be provided to both the end portions of the heat exchange tube 3 in the width direction to form the water flow passages 10B by the groove portions 11, which are formed by cutting out the thick portion 9 over the range of from the upper side to the lower side.

Figure 8:
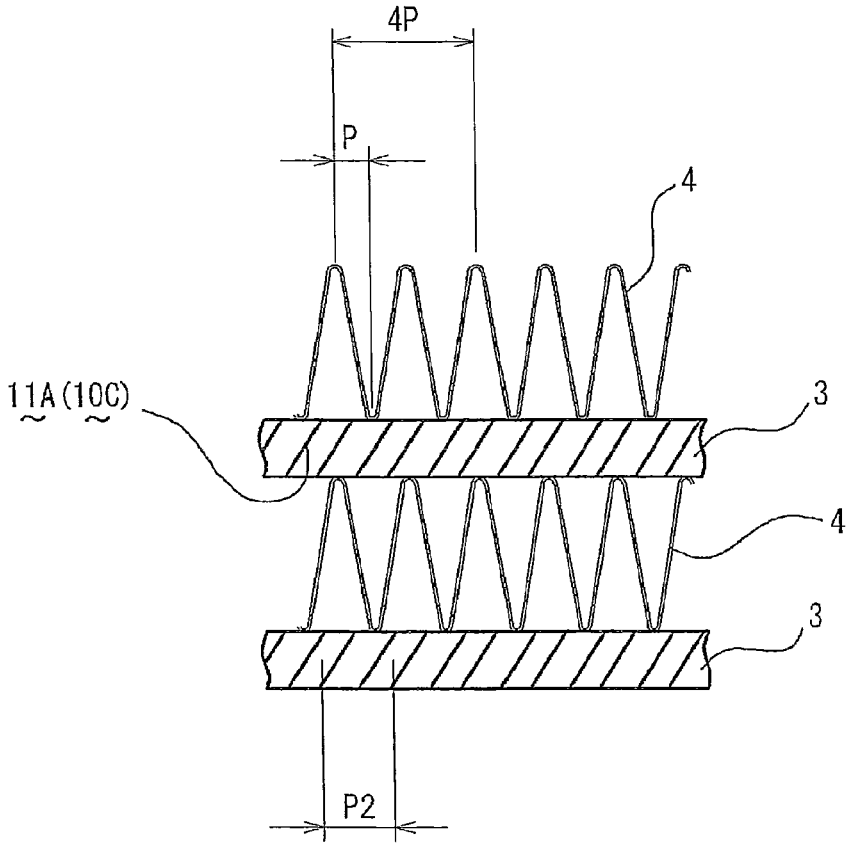
FIG. 8 is a main portion front view illustrating another form of the water flow passages according to the second embodiment.
Figure 9:
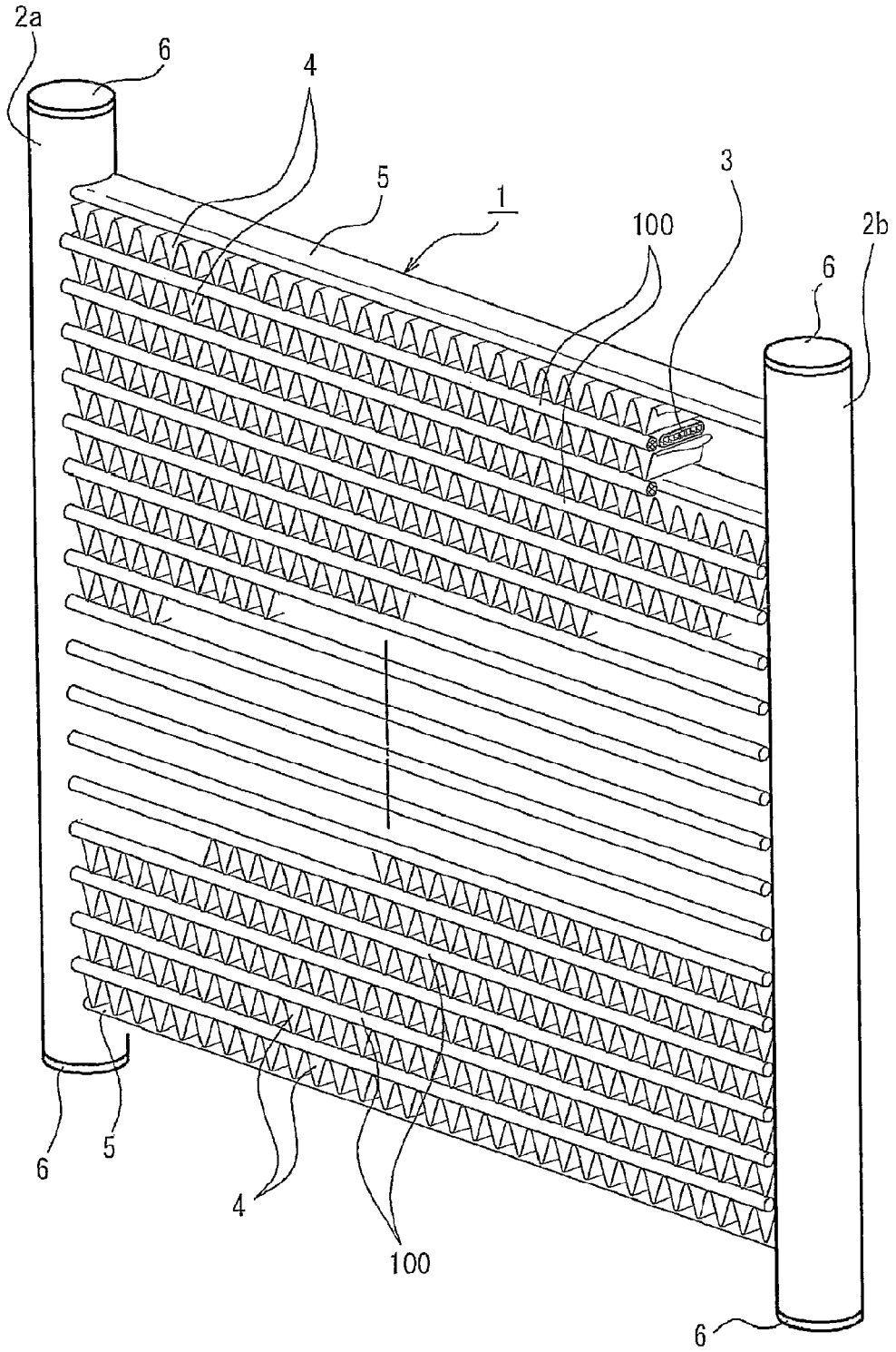
FIG. 9 is a perspective view illustrating a partial cross section of a drain structure according to a third embodiment of the present invention.
Figure 10:
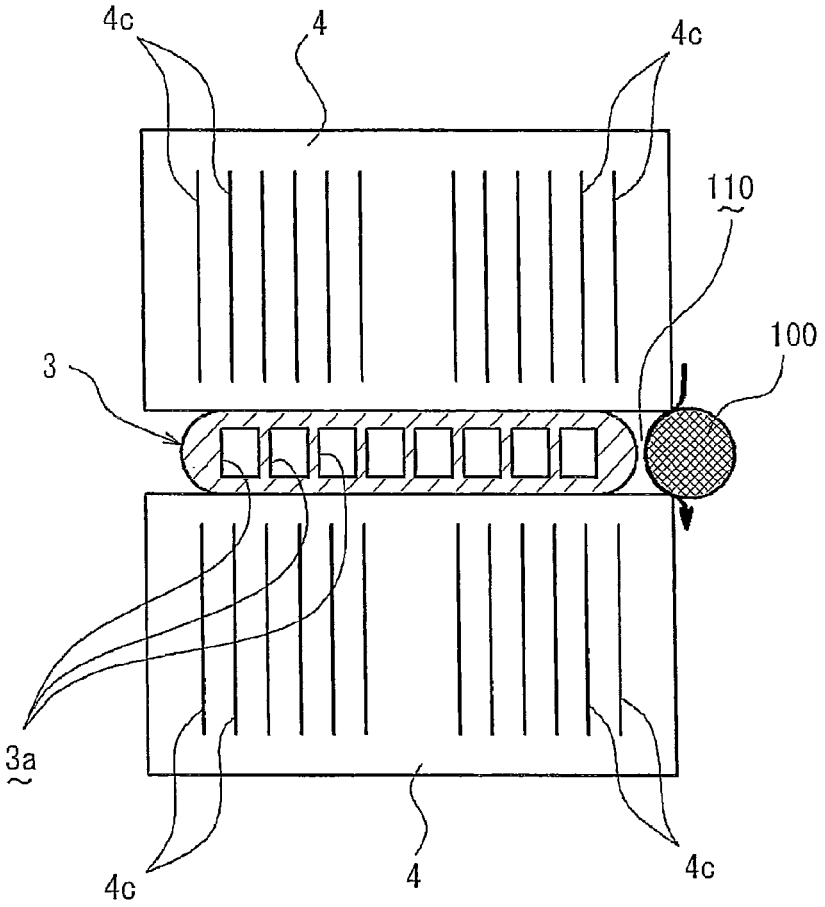
FIG. 10 is an enlarged cross-sectional view illustrating a main portion of the drain structure according to the third embodiment of the present invention.

Note that, as illustrated in FIG. 8, water flow passages 100 may be formed by a groove portion 11A, which are formed through cutting performed obliquely to the heat exchange tube 3.

Also in this case, in order to obtain a practically effective drain effect, as illustrated in FIGS. 5(*b*) and 8, it is preferred that the pitch P2 of the water flow passages 10B (100), that is, the groove portions 11 (11A), be four times or smaller than the pitch P of the corrugated fin 4 (peak-to-valley dimension).

According to the drain structure of the second embodiment having the above-mentioned configuration, when the surface of the heat exchanger becomes wet, under a state in which the condensed water (dew water) in the form of water droplets, which is condensed on the surface of the corrugated fin 4, is retained between the corrugated fins 4 adjacent to the upper and lower sides of the heat exchange tube 3, the edge portions of the groove portions 11 (11A) {water flow passages 10B (11C)} are brought into contact with the retained water, and therefore serve as a water-falling origin. As a result, the water can be induced and drained to the lower corrugated fin 4. Subsequently, in the same manner, the condensed water (dew water) in the form of water droplets, which is condensed on the surface of the corrugated fin 4, is sequentially drained to the lower corrugated fin 4.

According to the drain structures of the first and second embodiments having the above-mentioned configurations, a plurality of water flow passages 10 (10A, 10B, 10C) for inducing water retained between the corrugated fins 4 adjacent to the upper and lower sides of the heat exchange tube 3 are formed on the outer end surface of the heat exchange tube 3 in the width direction at the appropriate pitch along the longitudinal direction of the heat exchange tube 3. Thus, under the state in which the water droplets adhering to the heat exchanger 1 are retained between the corrugated fins 4, the edge portions of the water flow passages 10 (10A, 10B, 10C) are brought into contact with the retained water, and therefore serve as the water-falling origin. As a result, the water can be induced and drained to the lower corrugated fin 4. Accordingly, a sufficient drainage is obtained even in a case where the flat heat exchange tubes 3 are horizontally arranged.

Further, the water flow passages 10 (10A, 10B, 10C) are formed in the end portion of the heat exchange tube 3, and hence the flow of air passing through the heat exchanger 1 is not inhibited. Thus, it is possible to suppress an adverse effect on the airflow resistance and the heat exchange efficiency.

Still further, the water flow passages 10 (10A, 10B, 10C) are formed in the heat exchange tube 3 to provide the heat exchanger itself with the drain prompting mechanism, and hence the number of components does not need to be increased and the components can be assembled easily. As a result, the heat exchanger 1 can be manufactured easily.

Next, referring to FIGS. 9 to 15, description is given of drain structures according to other embodiments of the present invention. In FIGS. 9 to 15, the heat exchanger 1 is the same as those in the above-mentioned first and second embodiments, and hence the same components are represented by the same reference symbols to omit their description.

In the heat exchanger 1 having the above-mentioned configuration, on the side end portion of the heat exchange tube 3 in the width direction, a linear drain assisting member 100 is arranged so as to extend along the heat exchange tube 3 and to come into contact with the corrugated fins 4 adjacent to the upper and lower sides of the heat exchange tube 3. The drain assisting member 100 forms a water passage for inducing the water droplets adhering to the heat exchanger 1. In this case, the drain assisting member 100 is formed of, for example, a single linear wire made of aluminum or a synthetic resin, and the water passage is formed by a clearance 110 between the drain assisting member 100 and the heat exchange tube 3.

The heat exchanger 1 having the above-mentioned configuration is generally constituted by assembling the heat exchange tubes 3, the corrugated fins 4, and the like between the header pipes 2*a* and 2*b*, and then integrally brazing (joining) those components by brazing. At this time, in a case where the drain assisting member 100 is formed of a wire made of aluminum, instead of the method of brazing (joining) the heat exchanger 1 itself in a normal manner and then separately fixing the drain assisting member 100, there may be employed a method of providing the drain assisting member 100 along the heat exchange tube 3 and then integrally brazing (joining) the drain assisting member 100 together with the heat exchanger. Note that, in a case where the drain assisting member 100 is formed of a wire made of a synthetic resin, the heat exchanger 1 itself is brazed (joined) and then the drain assisting member 100 is fixed with an adhesive or the like.

According to the drain structure having the above-mentioned configuration, when the surface of the heat exchanger becomes wet, the water droplets adhering to the corrugated fin 4 are induced to the clearance 110 between the drain assisting member 100 and the heat exchange tube 3, and are drained to the lower corrugated fin 4 with the clearance 110 serving as the water passage. Subsequently, in the same manner, the water droplets adhering to the corrugated fin 4 are sequentially drained to the lower corrugated fin 4.

The above-mentioned third embodiment has described the case where the drain assisting member 100 is formed of a single wire, but a drain assisting member having a different shape may be used.

Figure 11:
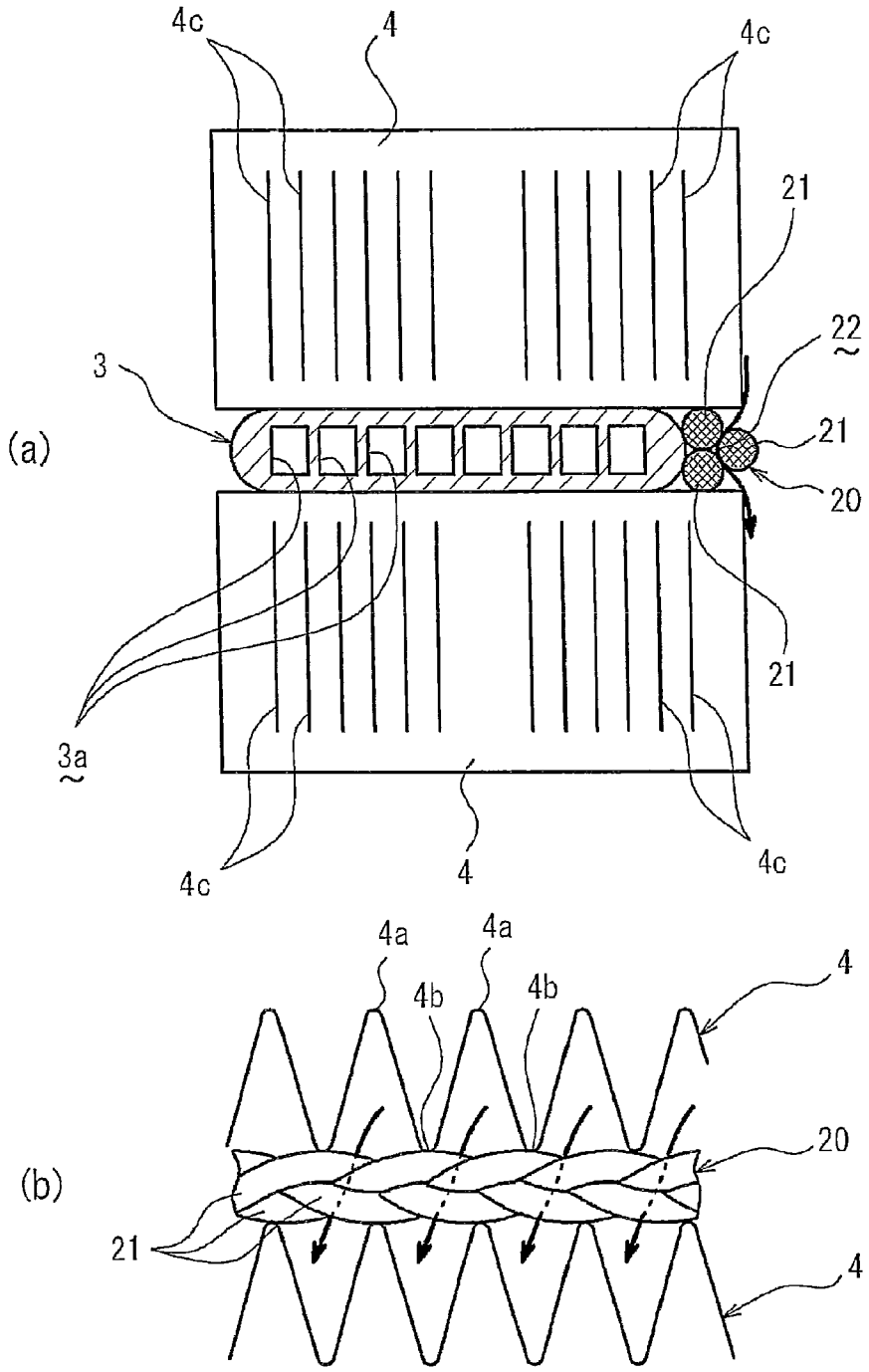
FIG. 11(*a*) is an enlarged cross-sectional view illustrating a main portion of a drain structure according to a fourth embodiment of the present invention, and FIG. 11(*b*) is a side view of FIG. 11(*a*).

For example, in a fourth embodiment illustrated in FIG. 11, a drain assisting member 20 has a shape in which a plurality of linear materials 21 made of aluminum, for example, two or three linear materials 21 (FIG. 11 illustrate a case of three linear materials 21), are twisted together, and the water passage is formed in a clearance 22 defined among the respective linear materials 21. In this case, the clearance 22 is positioned on the inner side of the side end of the corrugated fin 4.

According to the structure of the fourth embodiment having the above-mentioned configuration, as illustrated in FIG. 11(*b*), by the capillary phenomenon, the water droplets adhering to the corrugated fin 4 run into the drain assisting member 20 arranged in the vicinity thereof from an open peak portion 4*a* of a corrugated shape, that is, a peak-4*a*-to-valley-4*b* shape, and are drained to the lower corrugated fin 4 with the gap of the drain assisting member 20 itself, that is, the clearance 22 defined among the linear materials 21 serving as the water passage. Subsequently, in the same manner, the water droplets adhering to the corrugated fin 4 are sequentially drained to the lower corrugated fin 4.

Note that, in the above-mentioned fourth embodiment, other components are the same as those in the third embodiment, and hence the same components are represented by the same reference symbols to omit their description.

Further, in the above-mentioned third and fourth embodiments, in the case where the drain assisting member 100 is formed of a wire made of aluminum, the drain assisting member 100 is provided along the heat exchange tube 3 and is then integrally brazed (joined) together with the heat exchanger.

Figure 12:
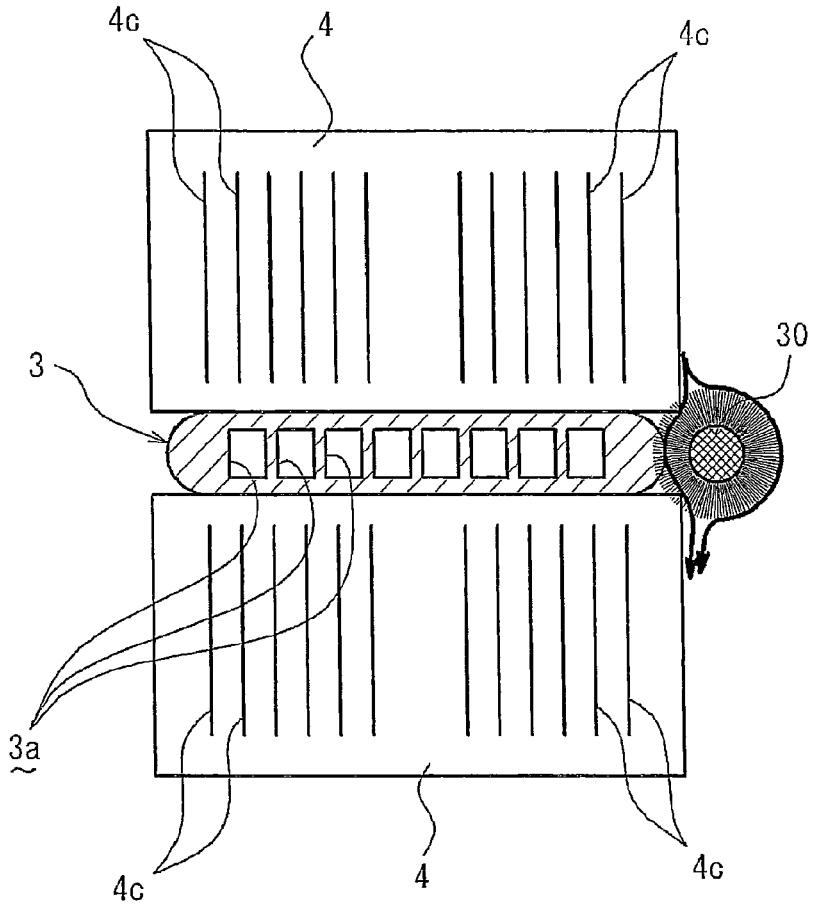
FIG. 12 is an enlarged cross-sectional view illustrating a main portion of a drain structure according to a fifth embodiment of the present invention.

Further, in a fifth embodiment illustrated in FIG. 12, a drain assisting member 30 is formed of wool or a chenille-laced linear material, and the water droplets adhering to a fuzzy surface of the drain assisting member 30 formed of the wool or chenille-laced linear material are induced to a water film or water droplets on the surface of the drain assisting member 30. Accordingly, the water passage is formed in this surface.

According to the structure of the fifth embodiment having the above-mentioned configuration, when the heat exchanger 1 becomes wet, the water droplets adhere to the surface of the wool or chenille-laced linear material forming the drain assisting member 30, and further the water film is formed on the surface. Further, the water droplets adhering to the corrugated fin 4 are induced to the water film or water droplets on the surface of the wool or chenille-laced linear material forming the drain assisting member 30 by the capillary phenomenon, and are drained to the lower corrugated fin 4 with the surface serving as the water passage. Subsequently, in the same manner, the water droplets adhering to the corrugated fin 4 are sequentially drained to the lower corrugated fin 4. Note that, other components in the fifth embodiment are the same as those in the third and fourth embodiments, and hence the same components are represented by the same reference symbols to omit their description.

The heat exchanger 1 including the drain structure of each of the third to fifth embodiments having the above-mentioned configurations is usable in the following condition.

Figure 13:
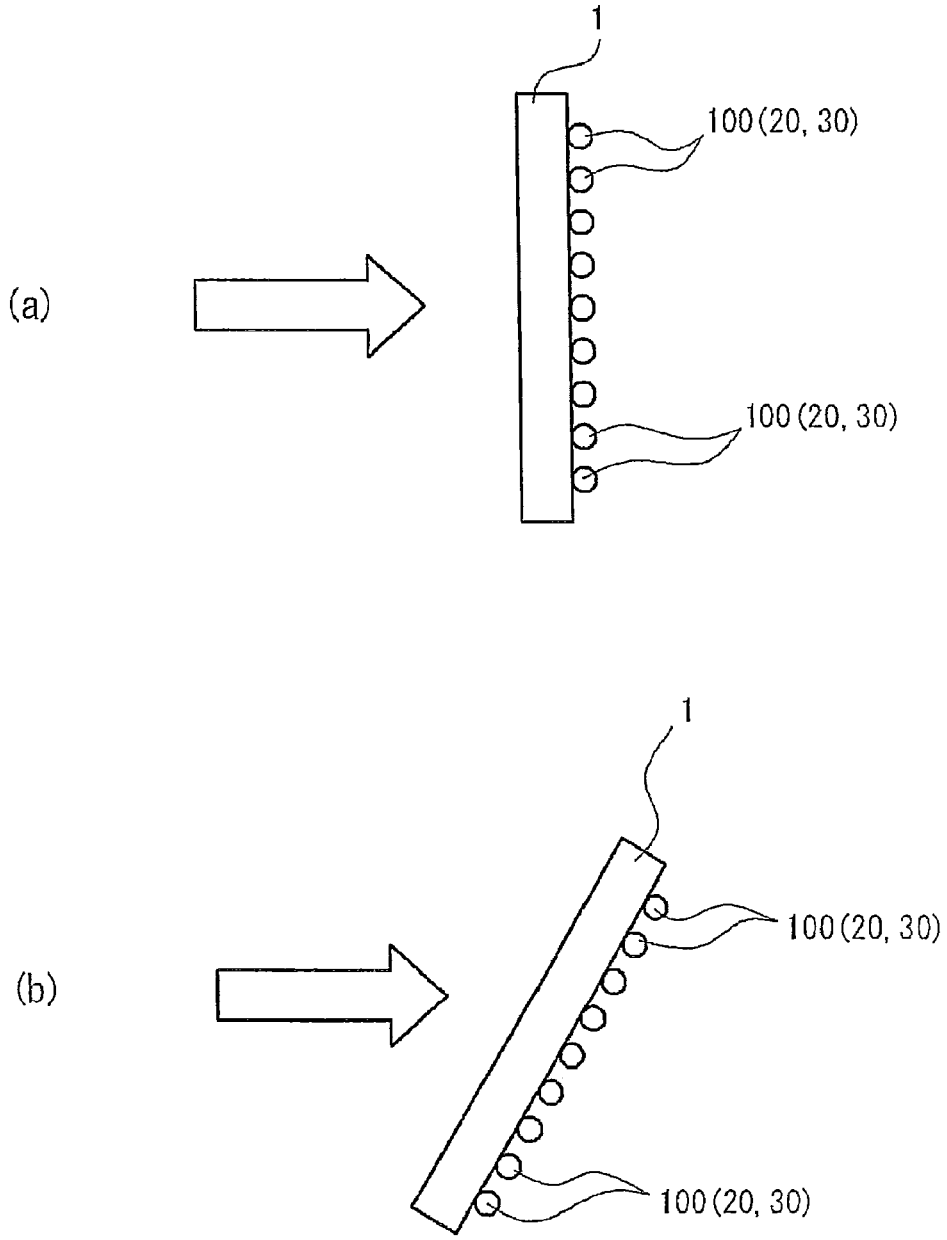
FIG. 13 are schematic side views illustrating a form in which the drain structure of each of the third to fifth embodiments is provided on a leeward side of the heat exchanger.

For example, as illustrated in FIG. 13, the heat exchanger 1 is usable in such a manner that the heat exchanger 1 is vertically arranged or obliquely arranged with the upper end side of the heat exchanger 1 positioned on a leeward side, and the drain assisting member 100, 20, or 30 (hereinafter, representatively indicated by reference numeral 100) is arranged on the leeward side.

With this configuration, as described above, the water droplets adhering to the heat exchanger 1 can more efficiently be drained, on the leeward side of the heat exchanger 1, from the upper corrugated fin 4 to the lower corrugated fin 4 while running through the water passage formed by the lower drain assisting member 100.

Figure 14:
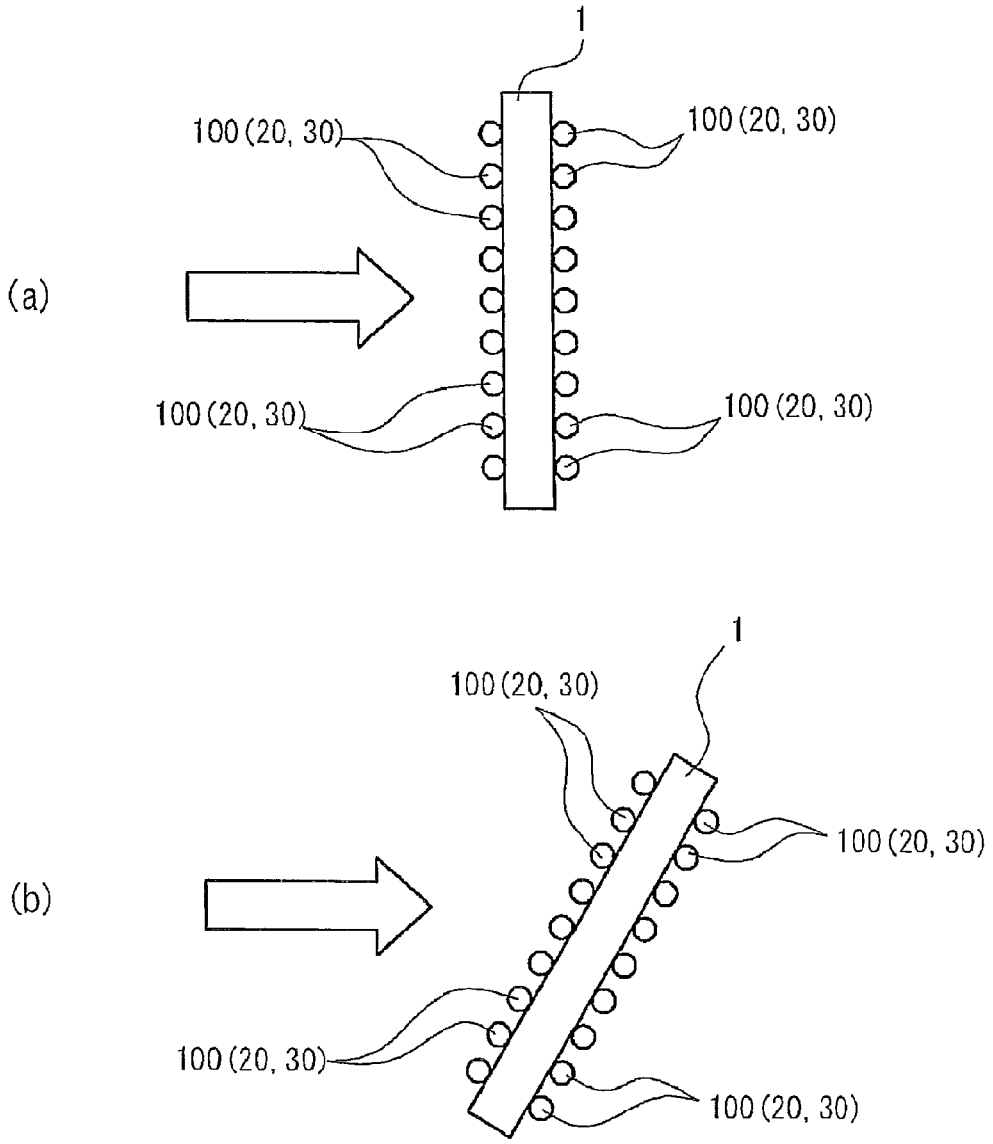
FIG. 14 are schematic side views illustrating a form in which the drain structure of each of the third to fifth embodiments is provided on a windward side and the leeward side of the heat exchanger.

Further, as illustrated in FIG. 14, the heat exchanger 1 is usable in such a manner that the heat exchanger 1 is vertically arranged or obliquely arranged with the upper end side thereof positioned on a leeward side, and the drain assisting member 100 is arranged on the windward side and the leeward side.

With this configuration, as described above, the water droplets adhering to the heat exchanger 1 can even more efficiently be drained, on the windward side and the leeward side of the heat exchanger 1, from the upper corrugated fin 4 to the lower corrugated fin 4 while running through the water passage formed by the lower drain assisting member 100.

Figure 15:
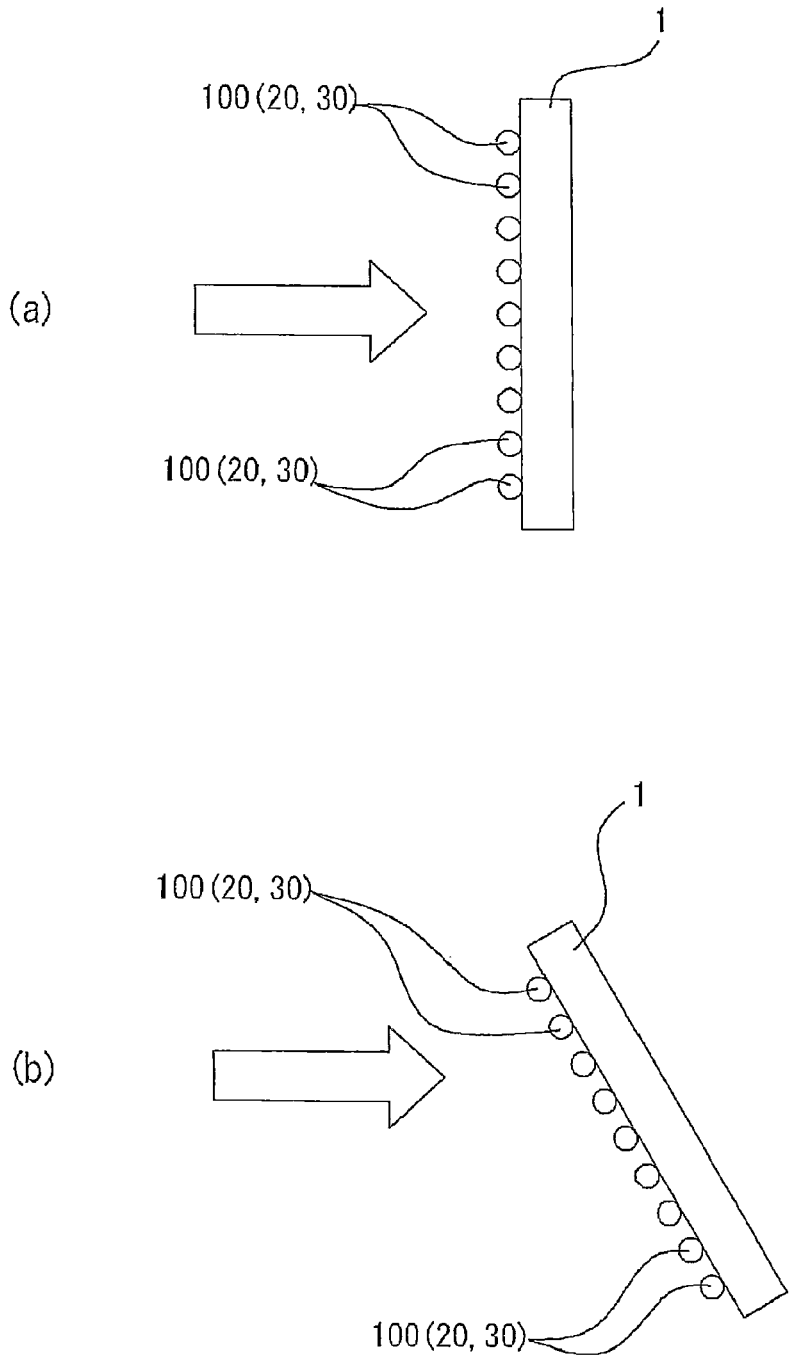
FIG. 15 are schematic side views illustrating a form in which the drain structure of each of the third to fifth embodiments is provided on the windward side of the heat exchanger.

Further, as illustrated in FIG. 15, the heat exchanger 1 may be used in such a manner that the heat exchanger 1 is vertically arranged or obliquely arranged with the upper end side of the heat exchanger 1 positioned on a windward side, and the drain assisting member 100 is arranged on the windward side.

With this configuration, as described above, the water droplets adhering to the heat exchanger 1 can be drained, on the windward side of the heat exchanger 1, from the upper corrugated fin 4 to the lower corrugated fin 4 while running through the water passage formed by the lower drain assisting member 100.

According to the drain structures of the third to fifth embodiments having the above-mentioned configurations, the linear drain assisting member 100 (20 or 30) is arranged so as to extend along the heat exchange tube 3 and to come into contact with the corrugated fins 4 adjacent to the upper and lower sides of the heat exchange tube 3, and the drain assisting member 100 (20 or 30) forms the water passage for inducing the water droplets adhering to the heat exchanger 1, that is, the clearance 110 (22). Thus, it is possible to allow the water droplets adhering to the heat exchanger 1 to run through the upper corrugated fin 4 to flow into the drain assisting member 100 (20 or 30) arranged along the lower heat exchange tube 3, and to be drained to the lower corrugated fin 4 via the clearance 110 (22) formed by the drain assisting member 100 (20 or 30). Accordingly, a sufficient drainage is obtained even in the case where the flat heat exchange tubes 3 are horizontally arranged.

Further, the drain assisting member 100 (20 or 30) is arranged along the heat exchange tube 3, and hence the flow of air passing through the heat exchanger 1 is not inhibited by the added drain assisting member itself. Thus, it is possible to suppress the adverse effect on the airflow resistance and the heat exchange efficiency.

Still further, the drain assisting member 100 (20 or 30) can be assembled to the heat exchanger 1 more easily than in the case where a linear material such as a wire is obliquely arranged on the surface of the heat exchanger. Further, in the case where the drain assisting member 100 (20) is formed of a wire made of aluminum, the drain assisting member 100 (20) can integrally be brazed (joined) together with the heat exchanger 1. As a result, the heat exchanger 1 can be manufactured easily.

INDUSTRIAL APPLICABILITY

The present invention is useful when used in an evaporator. However, even in a parallel flow corrugated fin-type heat exchanger other than the evaporator, it is possible to provide a sufficient drainage of water droplets adhering to a surface thereof to suppress an adverse effect on an airflow resistance and a heat exchange efficiency, even in a case where heat exchange tubes are arranged horizontally.

REFERENCE SIGNS LIST

1 heat exchanger
2*a*, 2*b* header pipe
3 heat exchange tube
4 corrugated fin
4*c* fin louver
7 flange portion
8, 8A lug piece
9 thick portion
10, 10A, 10B, 10C water flow passage
11, 11A groove portion
P pitch of corrugated fin
P1 pitch of lug pieces
P2 pitch of groove portions
100 drain assisting member
110 clearance
20 drain assisting member
21 linear material
22 clearance
30 drain assisting member (wool, chenille-laced linear material)

The invention claimed is:

1. A drain structure for a corrugated fin-type heat exchanger, comprising:

a pair of opposing header pipes;

a plurality of flat heat exchange tubes, each having an upper surface, a lower surface, side surfaces, and the end portion;

a plurality of corrugated fins formed by repeatedly accordion-folding; and a plurality of lug pieces on the side surfaces of each of the flat heat exchange tubes, wherein each of the flat heat exchange tubes is connected to the pair of the opposing header pipes at the end portions of the flat heat exchange tube so that the flat heat exchange tube is disposed between the pair of the opposing header pipes, and parallel to one another in a horizontal direction, the corrugated fins are disposed between the flat heat exchange tubes so that each of the corrugated fins is connected to the upper surface of the flat heat exchange tube beneath the corrugated fins and the lower surface of the flat heat exchange tube above the corrugated fins, the lug pieces are disposed under a state of being cut and lugged obliquely via cutouts on each of the side surfaces of a flange portion of the flat heat exchange tubes, which extends along the flat heat exchange tubes in the width direction, each of the lug pieces directly and linearly extends from the side surface of the flat heat exchange tube, and each of the lug pieces is disposed beneath an upper side of each of the corrugated fins and above a lower side of each of the corrugated fins, so that water flow passages having edge portions are formed on the side surfaces of the flat heat exchange tubes, the edge portions being configured to induce, in contact with, water retained between valleys of the corrugated fins adjacent to an upper side and a lower side of each of the flat heat exchange tubes, a plurality of the water flow passages are formed on each of the side surfaces of the flat heat exchange tubes at a pitch along a longitudinal direction extending from one of the pair of the opposing header pipes to the other of the pair of the opposing header pipes, the edge portion of each of the water flow passages comprises a corner portion, at which two surfaces of each of the lug pieces that are inclined in proximity to a horizontal surface portion of each of the flat heat exchange tubes cross each other, and at least part of each of the plurality of water flow passages is positioned on an inner side of a side end portion of each of the corrugated fins.

2. The drain structure for a corrugated fin-type heat exchanger according to claim 1, wherein the pitch of the plurality of water flow passages is in a range of four times or smaller than a pitch of each of the corrugated fins.

3. A drain structure for a corrugated fin-type heat exchanger, comprising:

a pair of opposing header pipes;

a plurality of flat heat exchange tubes, each having an upper surface, a lower surface, side surfaces, and an end portion;

a plurality of corrugated fins formed by repeatedly accordion-folding; and a plurality of linear drain assisting members arranged along the side surfaces of each of the plurality of flat heat exchange tubes, wherein each of the flat heat exchange tubes is connected to the pair of the opposing header pipes at the end portions of the flat heat exchange tube so that the flat heat exchange tube is disposed between the pair of the opposing header pipes, and parallel to one another in a horizontal direction, the corrugated fins are disposed between the flat heat exchange tubes so that each of the corrugated fins is connected to the upper surface of the flat heat exchange tube beneath the corrugated fins and the lower surface of the flat heat exchange tube above the corrugated fins, each of the plurality of linear drain assisting members is arranged so as to be interposed between and held in contact with the corrugated fins adjacent to an upper side and a lower side of the each of the plurality of flat heat exchange tubes, to thereby form a water passage for inducing water droplets adhering to the corrugated fin-type heat exchanger, the each of the plurality of linear drain assisting members has a shape in which a plurality of linear materials are twisted together, and the water passage is formed in a clearance defined among the plurality of linear materials, and the clearance of the each of the plurality of linear drain assisting members is positioned on an inner side of a side end of each of the corrugated fins.

4. The drain structure for a corrugated fin-type heat exchanger according to claim 3, wherein the linear drain assisting member comprises a wire arranged to define a fine clearance so as to form the water passage between the wire and the each of the plurality of flat heat exchange tubes.

5. The drain structure for a corrugated fin-type heat exchanger according to claim 3, wherein the linear drain assisting member is formed of the same material forming the corrugated fin-type heat exchanger, and is integrally joined to the corrugated fin-type heat exchanger by brazing.

6. The drain structure for a corrugated fin-type heat exchanger according to claim 3, wherein the linear drain assisting member comprises wool or a chenille-laced linear material, and wherein water droplets adhering to a surface of the wool or the chenille-laced linear material are induced to a water film or water droplets on a surface of the linear drain assisting member, and the water passage is formed in the surface.

7. The drain structure for a corrugated fin-type heat exchanger according to any one of claims 3, 4, 5, and 6, wherein the corrugated fin-type heat exchanger is vertically arranged or obliquely arranged with an upper end side of the corrugated fin-type heat exchanger positioned on a leeward side, and the linear drain assisting member is arranged on the leeward side.

8. The drain structure for a corrugated fin-type heat exchanger according to any one of claims 3, 4, 5, and 6, wherein the corrugated fin-type heat exchanger is vertically arranged or obliquely arranged with an upper end side of the corrugated fin-type heat exchanger positioned on a leeward side, and the linear drain assisting member is arranged on a windward side and the leeward side.

9. The drain structure for a corrugated fin-type heat exchanger according to any one of claims 3, 4, 5, and 6, wherein the corrugated fin-type heat exchanger is vertically arranged or obliquely arranged with an upper end side of the corrugated fin-type heat exchanger positioned on a windward side, and the linear drain assisting member is arranged on the windward side.

10. The drain structure for a corrugated fin-type heat exchanger according to claim 1, wherein a thickness of the flange portion is thicker than that of the flat heat exchange tube.

* * * * *